US008470749B2

(12) United States Patent
Seddon et al.

(10) Patent No.: US 8,470,749 B2
(45) Date of Patent: Jun. 25, 2013

(54) METHOD OF PREPARING AN OVERBASED OR NEUTRAL DETERGENT

(75) Inventors: Elisa Seddon, Lyndhurst, OH (US); Claire Hollingshurst, Heanor (GB); Brian R. Cunningham, Timberlake, OH (US); Alexander F. Psaila, Westerham (GB); David Hobson, Belper (GB); Mohamed G. Fahmy, Eastlake, OH (US); Willis P. Nichols, Cleveland, OH (US); John W. Dunkerley, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 939 days.

(21) Appl. No.: 12/097,822

(22) PCT Filed: Dec. 20, 2006

(86) PCT No.: PCT/US2006/062384

§ 371 (c)(1),
(2), (4) Date: Nov. 20, 2008

(87) PCT Pub. No.: WO2007/120352

PCT Pub. Date: Oct. 25, 2007

(65) Prior Publication Data

US 2009/0203563 A1 Aug. 13, 2009

Related U.S. Application Data

(60) Provisional application No. 60/752,195, filed on Dec. 20, 2005.

(51) Int. Cl.

| | |
|---|---|
| ***C10M 159/24*** | (2006.01) |
| ***C10M 159/22*** | (2006.01) |
| ***B02C 17/00*** | (2006.01) |

(52) U.S. Cl.
USPC ..... 508/391; 508/460; 508/574; 508/185; 241/170

(58) Field of Classification Search
USPC ..... 508/391, 185, 460, 574; 241/170
See application file for complete search history.

(56) References Cited

U.S. PATENT DOCUMENTS

| | | | | |
|---|---|---|---|---|
| 3,057,896 | A * | 10/1962 | Schlicht et al. | 556/85 |
| 3,525,599 | A | 8/1970 | Nield | |
| 3,609,117 | A * | 9/1971 | Deis et al. | 523/513 |
| 3,966,621 | A | 6/1976 | Watkins et al. | |
| 4,229,309 | A * | 10/1980 | Cheng et al. | 508/391 |
| 4,298,482 | A * | 11/1981 | Cheng et al. | 508/154 |
| 4,617,135 | A | 10/1986 | Muir | |
| 5,883,056 | A * | 3/1999 | Moulin et al. | 508/393 |
| 2008/0312340 | A1 * | 12/2008 | Hobson et al. | 514/769 |

FOREIGN PATENT DOCUMENTS

| | | |
|---|---|---|
| EP | 1018539 A2 | 7/2000 |
| EP | 1057886 A1 | 12/2000 |
| GB | 1096008 | 12/1967 |
| WO | 92/20694 | 11/1992 |
| WO | 2007/035626 A2 | 3/2007 |

OTHER PUBLICATIONS

Written Opinion of corresponding international Application No. PCT/US2006/062384, Mar. 5, 2008.
Search Report of corresponding international Application No. PCT/US2006/062384, Mar. 5, 2008.

* cited by examiner

*Primary Examiner* — Jim Goloboy
(74) *Attorney, Agent, or Firm* — Michael F. Esposito; David M. Shold

(57) ABSTRACT

The invention provides a process for preparing a neutral or an overbased detergent, the process by: reacting (a) a pre-prepared suspension comprising (i) a metal base with a mean particle size of 10 micrometers or less; (ii) a surfactant; and (iii) an organic medium in which the metal base is suspended typically by a physical process. An overbased detergent may be formed with a further reaction with acidifying overbasing agent. The invention further provides a lubricant composition containing said neutral and overbased detergent.

15 Claims, No Drawings

METHOD OF PREPARING AN OVERBASED OR NEUTRAL DETERGENT

FIELD OF INVENTION

The present invention relates to a method of preparing a neutral or an overbased detergent comprising reacting an acidifying overbasing agent, a suitable detergent substrate and a suspension of metal base. The invention further provides a lubricant composition containing said overbased detergent.

BACKGROUND OF THE INVENTION

It is known to use overbased detergents in an oil of lubricating viscosity to improve cleanliness. Overbased detergents include sulphonates, phenates, saligenins, salixarates or salicylates, and they provide alkalinity, typically, to neutralize sulphur-containing acids produced from the combustion of carbonaceous fuels. These detergents are prepared by a number of low and high temperature processes. However, the preparation of a highly overbased detergent is difficult e.g. the maximum TBN for sulphonate detergents is typically 400 TBN whilst other overbased detergents have even lower maximum TBN's. Further the processes for making overbased detergents require complex processing to obtain a high TBN and/or to produce a filterable overbased detergent. Therefore it would be advantageous to have a method of preparing a neutral and/or an overbased detergent with improved production processes (such as, lower in-line processing viscosity) and/or ability to make highly overbased detergents.

GB 1,096,008 discloses a lubricating composition containing dispersed alkaline earth metal compounds prepared by milling. The alkaline earth metal compounds are oil-insoluble with a particle size of 1 to 30 micrometers and are dispersed from 20 to 80 weight percent of the lubricating composition. The alkaline earth metal compounds prepared by milling are used to provide a lubricant with a direct source of TBN.

U.S. Patent Application 60/718,697 discloses a method of lubricating an internal combustion engine by supplying to the engine a metal base dispersed in an organic medium. The metal base has a high solids content and a mean particle size of at least 10 nanometers to less than 1 μm. The metal base provides the lubricant with a direct source of TBN.

U.S. Pat. No. 3,525,599 discloses a composition of matter of a dispersion of barium carbonate in an amine salt of an organic acid. The composition is prepared by carbonating barium carbonate in an amine salt of an organic acid in the presence of alcohol and a non-volatile diluent oil. The composition contains 45.8% of barium carbonate.

SUMMARY OF THE INVENTION

The present invention in one embodiment provides a process for preparing an overbased detergent, the process comprising: reacting (a) a pre-prepared suspension comprising (i) a metal base with a mean particle size of 10 micrometers or less; (ii) a surfactant; and (iii) an organic medium in which the metal base is suspended (typically by a physical process); (b) an acidifying overbasing agent; and (c) an acidic or neutralised detergent substrate, to form an overbased detergent.

In one embodiment the invention provides a process for preparing an overbased detergent, the process comprising: reacting (a) a pre-prepared suspension comprising (i) a metal base with a mean particle size of 10 micrometers or less; (ii) a surfactant; and (iii) an organic medium in which the metal base is suspended (typically by a physical process); (b) an acidifying overbasing agent; and (c) an acidic or neutralised detergent substrate, wherein the process involves adding 1 to 10 metal base additions, thereafter removing a substantial portion of the water and of the alcohols from the process, and a processing step of filtering or stripping the product to form the overbased metal detergent.

In one embodiment provides a process for preparing a neutral detergent, the process comprising: reacting (a) a pre-prepared suspension comprising (i) a metal base with a mean particle size of 10 micrometers or less; (ii) a surfactant; and (iii) an organic medium in which the metal base is suspended, in amounts such that the neutral detergent has metal ratio of 1 to 1.1.

In one embodiment the invention provides a lubricant or lubricant concentrate obtained (or obtainable) by admixing the neutral and/or overbased detergent from the process described herein with an oil of lubricating viscosity.

In one embodiment the invention provides a lubricant (or a lubricant concentrate) composition comprising: an oil of lubricating viscosity and the neutral and/or overbased detergent from the process described herein with an oil of lubricating viscosity.

DETAILED DESCRIPTION OF THE INVENTION

The present invention provides a method of preparing an overbased detergent as disclosed above and compositions thereof containing the overbased detergent.

As used herein, all mean particle size descriptions are determined by using a particle size measurement Coulter LS230. The mean particle size data is presented on a percent volume basis.

The term "metal ratio" is used in the prior art and herein to designate the ratio of the total chemical equivalents of the metal in the overbased salt to the chemical equivalents of the metal in the salt which would be expected to result in the reaction between the detergent substrate to be overbased and the basic metal compound according to the known chemical reactivity and stoichiometry of the two reactants. Thus, in a normal or neutral salt the metal ratio is one and, in an overbased salt, the metal ratio is greater than one. The overbased detergent of the invention may have a metal ratio not exceeding 40:1 (or 40). Often, salts having ratios of 2:1 to 35:1 are used.

In one embodiment the detergent is a neutral detergent. A neutral detergent typically has a metal ratio of 1 to 1.1.

A person skilled in the art of preparing overbased detergents will know of processing conditions required for adding metal base, carbonating (i.e adding acidifying overbasing agent), removing water, filtering or stripping.

In one embodiment the provides a process for preparing the detergent disclosed herein, optionally comprises adding in incremental additions the pre-prepared suspension, followed by removing at least a portion of the water and then adding in at least one of alcohols, co-surfactants or co-promoters. After adding at least one of alcohols, co-surfactants or co-promoters the process adds another incremental addition of the pre-prepared suspension, until the desired product is achieved.

As used herein the Total Base Number (TBN) is a measurement on the final overbased detergent containing the oil used in processing i.e. the final product has not been diluted in additional oil nor has oil been removed after processing.

The overbased detergent may have a total base number (TBN) ranging from 100 to 1300, or from 150 to 1000, or from 200 to 1000, or from 250 to 920.

When the overbased detergent formed by the process of the invention is a sulphonate or phenate detergent, the TBN may be at least 350 or 400 rising to 1000 or 920.

When the overbased detergent formed by the process of the invention is a phenate, salixarate or salicylate detergent, the TBN may be 105 to 500, or from 110 to 400, or from 120 to 350.

Neutral detergents typically have a TBN of less than that described above for overbased detergents. For example, neutral sulphonates tend to have a TBN of 60 or less; phenates and salicylates tend to have a TBN of 100 or less.

The overbased detergent often has a low in-process viscosity and a low final viscosity. As used herein the term "low" used in "low in-process viscosity" and a "low final viscosity" defines a viscosity that is lower than would be expected from a conventional overbased metal detergent.

In different embodiments the overbased detergent has a micelle mean particle size of less than 10 nm, or 8 nm or less, or 6 nm or less. Typically the overbased detergent may have a micelle mean particle size of 1 nm to 5 nm.

In one embodiment the suspension comprises components other than water.

Pre-Prepared Suspension

As used herein, the term "pre-prepared suspension" means the suspension (comprising (i) a metal base with a mean particle size of 10 micrometers or less; (ii) a surfactant; and (iii) an organic medium in which the metal base is suspended) is prepared prior to being reacted with (b) acidifying overbasing agent; and (c) an acidic or neutralised detergent substrate. A detailed description of making the suspension is disclosed in U.S. patent application Ser. No. 05/010631 and/or US Patent Application entitled "Process for Preparing Dispersion," filed by Hobson and Psaila on Nov. 10, 2005 (if the metal base is a multi-metal system i.e. containing two or more metal bases).

In one embodiment the suspension is a dispersion. Typically, the metal base is suspended uniformly in the organic medium by the physical process. In one embodiment the metal base is uniformly dispersed by the physical process.

The suspension may be prepared by a physical process. Examples of the physical process include static mixing, milling, grinding, crushing, agitating, or ultra-sonic radiating. The physical process typically requires one or more of static mixing, milling, grinding, crushing, agitating, or ultra-sonic radiating. Typically the physical process results in the metal base having a mean particle size of at least 10 nanometers to less than 1 μm (or to less than 500 nm, or to less than 300 nm). Milling processes include a rotor stator mixer, a vertical bead mill, a horizontal bead mill, basket milling, ball mill, pearl milling or mixtures thereof. In one embodiment, the physical process for preparing the suspension comprises milling in a vertical or horizontal bead mill.

In different embodiments the milling process may be carried out in a vertical or horizontal bead mill. Either bead mill processes cause the reduction of particle size of the metal base by high energy collisions of the metal base with at least one bead; and/or other metal base agglomerates, aggregates, solid particles; or mixtures thereof. The beads typically have a mean particle size and mass greater than the desired mean particle size of the metal base. In some instances the beads are a mixture of different mean particle size.

The mill typically contains beads present at least 40 vol %, or at least 60 vol % of the mill. A range include for example 60 vol % to 95 vol %.

In different embodiments the suspension may be opaque or semi-translucent to translucent or transparent.

Metal Base

The suspension of the metal base comprises a mono- or di- or tri- or tetra- or penta- or hexa-valent metal, or a mixture thereof. Typically the metal of the metal base is a monovalent or divalent metal. In one embodiment the metal base is derived from a mono- or di-valent metal including calcium, magnesium, barium, lithium, sodium, potassium, cerium, or mixtures thereof. The metal base optionally contains water of hydration or crystallisation. In one embodiment the metal base is crystalline. In different embodiments the metal comprises calcium or magnesium.

The amount of metal base present in the suspension may range from 5 wt % to 90 wt %, or from 10 wt % to 90 wt %, or from 17 wt % to 90 wt %, or from 25 wt % to 80 wt %, or from 35 wt % to 70 wt %, or from 40 wt % to 65 wt % of the suspension.

The metal base is typically in the form of a solid and is not appreciably soluble in the organic medium. In several embodiments the metal base has a mean particle size in the suspension ranging from 20 nanometers to less than 1 μm, or 30 nanometers to 0.7 μm, or 50 nanometers to 0.4 μm, or 80 nanometers to 0.3 μm.

The metal base generally comprises at least one of oxides, hydroxides or carbonates. Examples of a suitable metal base comprise at least one of sodium carbonate, sodium bicarbonate, potassium carbonate, potassium bicarbonate, potassium hydroxide, sodium hydroxide, lithium hydroxide, magnesium hydroxide, calcium hydroxide, lithium carbonate, calcium carbonate, magnesium carbonate, calcium oxide, magnesium oxide, lithium oxide, barium carbonate, barium oxide, barium hydroxide, cerium oxide or mixtures thereof. In one embodiment of the invention the metal base is present in a mixture, for instance dolmitic lime which is commercially available. In several embodiments the metal base comprises calcium hydroxide, calcium oxide, calcium carbonate, magnesium oxide, magnesium hydroxide or magnesium carbonate.

Acidic or Neutralised Detergent Substrate

The acidic or neutralised detergent substrate may comprise at least one of alkyl phenol, aldehyde-coupled alkyl phenol, sulphurised alkyl phenol, alkyl aromatic sulphonic acid (such as, alkyl naphthalene sulphonic acid, alkyl toluene sulphonic acid or alkyl benzene sulphonic acid), carboxylic acid, calixarene, salixarene, alkyl salicylic acid, or mixtures thereof.

In one embodiment the acidic or neutralised detergent substrate comprises one or more of alkyl aromatic sulphonic acid, calixarene, salixarene, alkyl salicylic acid, carboxylate or mixtures thereof.

In one embodiment the surfactant comprises at least one of a saligenin, a hydrocarbyl substituted aryl sulphonic acid, a polyolefin-substituted acylating agent, or salixarenes, or salts thereof.

When the detergent is formed the common nomenclature for the overbased detergent is a salixarate (from calixarene or salixarene), a sulphonate (from alkyl aromatic sulphonic acid), salicylate (from alkyl salicylic acid), or a phenate (from alkyl phenol, aldehyde-coupled alkyl phenol, sulphurised alkyl phenol), or a saligenin.

In different embodiments the overbased detergent formed from the acidic or neutralised detergent substrate may be a calcium or magnesium phenate (from alkyl phenol, aldehyde-coupled alkyl phenol, or sulphurised alkyl phenol), calcium or magnesium saligenins, calcium or magnesium alkyl aromatic sulphonate, calcium or magnesium salixarate, or calcium or magnesium alkyl salicylate.

In one embodiment the overbased detergent carboxylate may be derived from an aliphatic carboxylic acid. The aliphatic acid may contain 6 to 30, or from 7 to 16 carbon atoms.

Examples of a suitable carboxylic acid include caprylic acid, capric acid, lauric acid, myristic acid, myristoleic acid, decanoic acid, dodecanoic acid, pentadecanoic acid, palmitic acid, palmitoleic acid, margaric acid, stearic acid, 12-hydroxystearic acid, oleic acid, ricinoleic acid, linoleic acid, arachidic acid, gadoleic acid, eicosadienoic acid, behenic acid, erucic acid, tall oil fatty acids, rapeseed oil fatty acid, linseed oil fatty acid, or mixtures thereof. In one embodiment the aliphatic acids are oleic acid or tall oil fatty acid.

The carboxylate may have a metal ratio of 0.2 to 10, or from 0.5 to 7, or from 0.7 to 5. When overbased the metal ratio is greater than one.

The neutral or overbased detergent formed from a carboxylic acid detergent substrate may be salted with cerium, calcium, magnesium, barium, lithium, potassium or sodium.

In one embodiment the acidic or neutralised detergent substrate comprises mixtures of at least two of said substrates. When two or more detergent substrates are used, the overbased detergent formed may be described as a complex/hybrid. Typically the complex/hybrid may be prepared by reacting in the presence of the suspension and acidifying overbasing agent, alkyl aromatic sulphonic acid at least one alkyl phenol (such as, alkyl phenol, aldehyde-coupled alkyl phenol, sulphurised alkyl phenol) and optionally alkyl salicylic acid.

In one embodiment the acidic or neutralized detergent substrate may be the same as the surfactant employed to form the pre-prepared suspension. In one embodiment the acidic or neutralized detergent substrate may be different to the surfactant employed to form the pre-prepared suspension.

Acidifying Overbasing Agent

The acidifying overbasing agent used to prepare the overbased detergent may be a liquid, such as formic acid, acetic acid, nitric acid, sulphuric acid. Suitable inorganic acidifying agents include $SO_2$, $SO_3$, carbon dioxide, $H_2S$, or mixtures thereof. In different embodiments the acidifying overbasing agent is carbon dioxide or acetic acid. In one embodiment the acidifying overbasing agent is a mixture of carbon dioxide and acetic acid.

The acidifying overbasing agent may be added in 1 to 10, or from 1 to 6, or from 1 to 4, or from 1 to 2, or just 1 addition (one addition also encompasses a continuous addition of metal base during the process, as well adding all of the metal base added at one time). Typically the number of times the acidifying overbasing agent is the same as the number of metal base additions.

Surfactant

The surfactant includes an ionic (cationic or anionic) or non-ionic compound. Generally, the surfactant stabilises the suspension of the metal base in the organic medium.

Suitable surfactant compounds include those with a hydrophilic lipophilic balance (HLB) ranging from 1 to 40, or 1 to 20, or 1 to 18, or 2 to 16, or 2.5 to 15. In several embodiments the HLB may be 11 to 14, or less than 10 such as 1 to 8, or 2.5 to 6. Those skilled in the art will appreciate that combinations of surfactants may be used with individual HLB values outside of these ranges, provided that the composition of a final surfactant blend is within these ranges. When the surfactant has an available acidic group, the surfactant may become the metal salt of the acidic group and where the metal is derived from the metal base.

Examples of these surfactants suitable for the invention are disclosed in *McCutcheon's Emulsifiers and Detergents,* 1993, North American & International Edition. Generic examples include alkanolamides, alkylarylsulphonates, amine oxides, poly(oxyalkylene) compounds, including block copolymers comprising alkylene oxide repeat units (e.g., Pluronic™), carboxylated alcohol ethoxylates, ethoxylated alcohols, ethoxylated alkyl phenols, ethoxylated amines and amides, ethoxylated fatty acids, ethoxylated fatty esters and oils, fatty esters, glycerol esters, glycol esters, imidazoline derivatives, phenates, lecithin and derivatives, lignin and derivatives, monoglycerides and derivatives, olefin sulphonates, phosphate esters and derivatives, propoxylated and ethoxylated fatty acids or alcohols or alkyl phenols, sorbitan derivatives, sucrose esters and derivatives, sulphates or alcohols or ethoxylated alcohols or fatty esters, polyisobutylene succinimide and derivatives.

In one embodiment the surfactant comprises polyesters as defined in column 2, line 44 to column 3, line 39 of U.S. Pat. No. 3,778,287. Examples of suitable polyester surfactants are prepared in U.S. Pat. No. 3,778,287 as disclosed in Polyester Examples A to F (including salts thereof).

In one embodiment the surfactant is a hydrocarbyl substituted aryl sulphonic acid (or sulphonate) of an alkali metal, alkaline earth metal or mixtures thereof. The hydrocarbyl substituted aryl sulphonic acid may be synthetic or natural. The aryl group of the aryl sulphonic acid may be phenyl, tolyl or naphthyl. In one embodiment the hydrocarbyl substituted aryl sulphonic acid comprises alkyl substituted benzene sulphonic acid. In one embodiment the surfactants is a hydrocarbyl-substituted sulphonic acid, such as, polypropene benzenesulphonic acid, $C_{16}$-$C_{36}$ alkyl benzenesulphonic acid, and $C_{16}$-$C_{26}$ alkyl benzenesulphonic acid or mixtures thereof.

The hydrocarbyl (especially an alkyl) group typically contains 8 to 30, or 10 to 26, or 10 to 15 carbon atoms. In one embodiment the surfactant is a mixture of $C_{10}$ to $C_{15}$ alkylbenzene sulphonic acids. Examples of sulphonates include dodecyl and tridecyl benzenes or condensed naphthalenes or petroleum, sulphosuccinates and derivatives.

In one embodiment the surfactant is in the form of a neutral or overbased surfactant of a neutral or overbased surfactant typically salted with an alkali or alkaline earth metal. The alkali metal includes lithium, potassium or sodium; and the alkaline earth metal includes calcium or magnesium. In one embodiment the alkali metal is sodium. In one embodiment the alkaline earth metal is calcium.

Typical examples of a polyolefin include polyisobutene; polypropylene; polyethylene; a copolymer derived from isobutene and butadiene; a copolymer derived from isobutene and isoprene; or mixtures thereof.

In one embodiment the surfactant is a derivative of a polyolefin. Typically the derivative of a polyolefin comprises a polyolefin-substituted acylating agent optionally further reacted to form an ester and/or aminoester. The acylating agent may be a compound with one or more acid functional groups, such as a carboxylic acid or anhydride thereof. Examples of an acylating agent include an alpha, beta-unsaturated mono- or polycarboxylic acid, anhydride ester or derivative thereof. Examples of an acylating agent include (meth)acrylic acid, methyl (meth)acrylate, maleic acid or anhydride, fumaric acid, itaconic acid or anhydride, or mixtures thereof, where (meth) acrylic means acrylic or methacrylic.

In one embodiment the polyolefin is a derivative of polyisobutene with a number average molecular weight of at least 250, 300, 500, 600, 700, or 800, to 5000 or more, often up to 3000, 2500, 1600, 1300, or 1200. In one embodiment less than 5% by weight of the polyisobutylene used to make the derivative molecules have $\overline{Mn}$ less than 250, more. In one embodiment the polyisobutylene used to make the derivative has $\overline{Mn}$ of at least 800. In different embodiments the polyisobutylene used to make the derivative contains at least 30% terminal vinylidene groups, or at least 60% or at least 75% or 85% terminal vinylidene groups. In one embodiment the polyisobutylene used to make the derivative may have a polydispersity, $\overline{Mw}/\overline{Mn}$, greater than 5, more often from 6 to 20. In different embodiments the polyisobutylene used to make the derivative may have a polydispersity, $\overline{Mw}/\overline{Mn}$ of 1 to 5, or 2 to 4.

In various embodiments, the polyisobutene is substituted with succinic anhydride, the polyisobutene substituent has a number average molecular weight ranging from 1,500 to 3,000, or 1,800 to 2,300, or 700 to 1700, or 800 to 1000. The ratio of succinic groups per equivalent weight of the polyisobutene typically ranges from 1.3 to 2.5, or 1.7 to 2.1, or 1.0 to 1.3, or 1.0 to 1.2.

In one embodiment the surfactant is polyisobutenyl-dihydro-2,5-furandione ester with pentaerythritol or mixtures thereof. In one embodiment the surfactant is a polyisobutylene succinic anhydride derivative such as a polyisobutylene succinimide or derivatives thereof. In one embodiment the surfactant is substantially free to free of a basic nitrogen.

Other typical derivatives of polyisobutylene succinic anhydrides include hydrolysed succinic anhydrides, esters or diacids. Polyisobutylene succan derivatives are preferred to make the metal base suspensions. A large group of polyisobutylene succinic anhydride derivatives are taught in U.S. Pat. No. 4,708,753, and U.S. Pat. No. 4,234,435.

In another embodiment the surfactant comprises a salixarene (or salixarate if in the form of a metal salt). The salixarene is defined as an organic substrate of a salixarate. The salixarene may be represented by a substantially linear compound comprising at least one unit of the formulae (I) or (II):

(I)

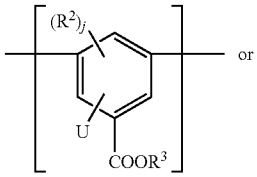

or (II)

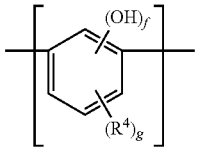

each end of the compound having a terminal group of formulae (III) or (IV):

(III)

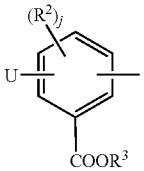

-continued (IV)

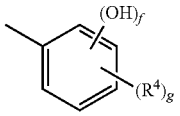

such groups being linked by divalent bridging groups, which may be the same or different for each linkage; wherein f is 1, 2 or 3, in one aspect 1 or 2; $R^1$ is a hydrocarbyl group containing 1 to 5 carbon atoms; $R^2$ is hydroxyl or a hydrocarbyl group; j is 0, 1, or 2; $R^3$ is hydrogen or a hydrocarbyl group; $R^4$ is a hydrocarbyl group or a substituted hydrocarbyl group; g is 1, 2 or 3, provided at least one $R^4$ group contains 8 or more carbon atoms; and wherein the compound on average contains at least one of unit (I) or (III) and at least one of unit (II) or (IV) and the ratio of the total number of units (I) and (III) to the total number of units of (II) and (IV) in the composition is about 0.1:1 to about 2:1.

The U group in formulae (I) and (III) may be located in one or more positions ortho, meta, or para to the —$COOR^3$ group. The U group may be located ortho to the —$COOR^3$ group. When the U group comprises a —OH group, formulae (I) and (III) are derived from 2-hydroxybenzoic acid (often called salicylic acid), 3-hydroxybenzoic acid, 4-hydroxybenzoic acid or mixtures thereof. When U is a —$NH_2$ group, formulae (I) and (III) are derived from 2-aminobenzoic acid (often called anthranilic acid), 3-aminobenzoic acid, 4-aminobenzoic acid or mixtures thereof.

The divalent bridging group, which may be the same or different in each occurrence, includes a methylene bridge such as —$CH_2$— or —CH(R)— and an ether bridge such as —$CH_2OCH_2$— or —CH(R)OCH(R)— where R is an alkyl group having 1 to 5 carbon atoms and where the methylene and ether bridges are derived from formaldehyde or an aldehyde having 2 to 6 carbon atoms.

Often the terminal group of formulae (III) or (IV) contains 1 or 2 hydroxymethyl groups ortho to a hydroxy group. In one embodiment of the invention hydroxymethyl groups are present. In one embodiment of the invention hydroxymethyl groups are not present. A more detailed description of salixarene and salixarate chemistry is disclosed in EP 1 419 226 B1, including methods of preparation as defined in Examples 1 to 23 (page 11, line 42 to page 13, line 47).

In one embodiment the surfactant is substantially free of, to free of, a fatty acid or derivatives thereof, such as esters. In one embodiment the surfactant is other than a fatty acid or derivatives thereof.

In one embodiment the surfactant comprises at least of hydrocarbyl substituted aryl sulphonic acids, derivatives of polyolefins, polyesters or salixarenes.

In different embodiments the surfactant is substantially free of, to free of, phospholipids, (such as lecithin) and/or amino acids (such as sarcosines).

In one embodiment the surfactant has a molecular weight of less than 1000, in another embodiment less than 950, for example, 250, 300, 500, 600, 700, or 800.

The amount of surfactant and metal base in the suspension may vary as is shown in Table 1. The balance is the organic medium and optionally water. In one embodiment the amount of oil present in the suspension varies from 25 wt % to 55 wt %.

TABLE 1

| Additive | Embodiments (wt % of suspension) 1 | 2 | 3 | 4 |
|---|---|---|---|---|
| Metal Base | 17-90 | 25-80 | 35-70 | 40-65 |
| Surfactant | 0.01-30 | 1-30 | 2-30 | 5-25 |

Organic Medium

The organic medium comprises an oil of lubricating viscosity, a liquid fuel, a hydrocarbon solvent or mixtures thereof. Typically the organic solvent comprises an oil of lubricating viscosity.

Optionally the organic medium contains water, typically up to 1 wt %, or 2 wt % or 3 wt % of the suspension. In different embodiments the organic medium is substantially free of, to free of, water.

As used herein the term "free of", as used in the specification and claims, defines the absence of a material except for the amount which is present as impurities, e.g., a trace amount or a non-effective amount. Typically in this embodiment, the amount present will be less than 0.05% or less than 0.005 wt % by weight of the suspension and/or overbased detergent.

Oils of Lubricating Viscosity

In one embodiment the organic medium comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≦0.03 wt %, and ≧90 wt % saturates, viscosity index 80-120); Group III (sulphur content ≦0.03 wt %, and ≧90 wt % saturates, viscosity index ≧120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group I, Group II, Group III oil or mixtures thereof.

In an alternative embodiment the organic medium comprises a liquid fuel. The fuel comprises a liquid fuel and is useful in fueling an internal combustion engine or open flame combustion system. The liquid fuel is normally a liquid at ambient conditions. The liquid fuel includes a hydrocarbon fuel, a nonhydrocarbon fuel, or a mixture thereof. The hydrocarbon fuel may be a petroleum distillate to include a gasoline as defined by ASTM (American Society for Testing and Materials) specification D4814 or a diesel fuel as defined by ASTM specification D975. In an embodiment the liquid fuel is a gasoline, and in another embodiment the liquid fuel is a leaded gasoline, or a nonleaded gasoline. In another embodiment the liquid fuel is a diesel fuel. The hydrocarbon fuel includes a hydrocarbon prepared by a gas to liquid process for example hydrocarbons prepared by a process such as the Fischer-Tropsch process. The nonhydrocarbon fuel includes an oxygen containing composition (often referred to as an oxygenate), an alcohol, an ether, a ketone, an ester of a carboxylic acid, a nitroalkane, or a mixture thereof. The nonhydrocarbon fuel includes methanol, ethanol, methyl t-butyl ether, methyl ethyl ketone, trans-esterified oils and/or fats from plants and animals such as rapeseed methyl ester and soybean methyl ester, and nitromethane. Mixtures of hydrocarbon and nonhydrocarbon fuels include gasoline and methanol and/or ethanol, diesel fuel and ethanol, and diesel fuel and a transesterified plant oil such as rapeseed methyl ester. In one embodiment the liquid fuel is a nonhydrocarbon fuel, or a mixture thereof.

Optionally the process further comprises at least one of mixtures of alcohols, co-surfactants or co-promoters.

In one embodiment the process does not employ a carbonation catalyst, such as, acetic acid.

In one embodiment the process does not employ an alcohol other than methanol.

In one embodiment the process does not require methanol.

Known co-surfactants or co-promoters chemistry include acetic acid, fatty acid (such as, stearic acid), calcium acetate, a calcium salt of a formaldehyde coupled aliphatic phenol, hydroxy-sulphonic acids, inorganic halides (such as ammonium halides, alkaline earth metal halides especially calcium chloride or alkali metal halides) or an inorganic calcium salt, such as, calcium nitrate. In one embodiment the co-surfactants or co-promoters are selected from the group consisting of a calcium salt of formaldehyde coupled aliphatic phenols, a hydroxy-sulphonic acids, inorganic halides and inorganic calcium salts.

The mixture of alcohols include methanol and a mixture of alkyl substituted alcohols containing 2 to 7, or from 2 to 6, or from 3 to 5 carbon atoms. The mixture of alcohols containing 2 to 7 carbon atoms may include branched or linear alkyl chains or mixtures thereof, although branched is typically used.

The mixture of alcohols can contain ethanol, propan-1-ol, propan-2-ol, isopropanol, butan-1-ol, butan-2-ol, isobutanol, pentan-1-ol, pentan-2-ol, pentan-3-ol, isopentanol, hexan-1-ol, hexan-2-ol, hexan-3-ol, heptan-1-ol, heptan-2-ol, heptan-3-ol, heptan-4-ol or mixtures thereof. In one embodiment, the mixture of alcohols contains at least one butanol and at least one amyl alcohol. The mixture of alcohols is commercially available as isoamyl alcohol from Union Carbide or other suppliers.

The overbased detergent of the invention may be used as a sole additive for a lubricant composition. In one embodiment the neutral and/or overbased detergent of the invention is used as one additive in combination with other performance additives.

In one embodiment the invention provides a lubricant composition comprising (i) the neutral and/or overbased detergent of the invention; (ii) an oil of lubricating viscosity; and (iii) other performance additives.

The lubricant composition may be in the form of a concentrate and/or a fully formulated lubricant. If the overbased detergent of the present invention is in the form of a concentrate (which may be combined with additional oil to form, in whole or in part, a finished lubricant), the ratio of the detergent to the oil of lubricating viscosity and/or to diluent oil include the ranges of 1:99 to 99:1 by weight, or from 80:20 to 10:90 by weight.

The lubricant composition comprises an oil of lubricating viscosity as defined above.

Other Performance Additives

The lubricant composition optionally comprises other performance additives. The other performance additives comprise at least one of metal deactivators, conventional detergents (detergents prepared by conventional processes known in the art), dispersants, viscosity modifiers, friction modifiers, corrosion inhibitors, dispersant viscosity modifiers, extreme pressure agents, antiscuffing agents, antioxidants, foam inhibitors, demulsifiers, pour point depressants, seal swelling agents and mixtures thereof. Typically, fully-formulated lubricating oil will contain one or more of these performance additives.

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range 350 to 5000, or 500 to 3000. Succinimide dispersants and their preparation are disclosed, for instance in U.S. Pat. No. 4,234,435. Succinimide dispersants are typically the imide formed from a polyamine, typically a poly (ethyleneamine).

In one embodiment the invention further comprises at least one dispersant derived from polyisobutylene succinimide with number average molecular weight in the range 350 to 5000, or 500 to 3000. The polyisobutylene succinimide may be used alone or in combination with other dispersants.

In one embodiment the invention further comprises at least one dispersant derived from polyisobutylene, an amine and zinc oxide to form a polyisobutylene succinimide complex with zinc. The polyisobutylene succinimide complex with zinc may be used alone or in combination.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

Detergents

The lubricant composition optionally further comprises other known neutral or overbased detergents i.e. ones prepared by conventional processes known in the art. Suitable detergent substrates include, phenates, sulphur containing phenates, sulphonates, salixarates, salicylates, carboxylic acid, phosphorus acid, mono- and/or di-thiophosphoric acid, alkyl phenol, sulphur coupled alkyl phenol compounds, or saligenins.

Antioxidant

Antioxidant compounds are known and include sulphurised olefins, diphenylamines, hindered phenols, molybdenum dithiocarbamates, and mixtures thereof. Antioxidant compounds may be used alone or in combination.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol 2,6-di-tert-butylphenol. In one embodiment the hindered phenol antioxidant is an ester and may include, e.g., Irganox™ L-135 from Ciba. A more detailed description of suitable ester-containing hindered phenol antioxidant chemistry is found in U.S. Pat. No. 6,559,105.

Suitable examples of molybdenum dithiocarbamates which may be used as an antioxidant include commercial materials sold under the trade names such as Vanlube 822™ and Molyvan™ A from R. T. Vanderbilt Co., Ltd., and Adeka Sakura-Lube™ S-100, S-165 and S-600 from Asahi Denka Kogyo K. K and mixtures thereof.

Viscosity Modifiers

Viscosity modifiers include styrene-butadiene rubbers, ethylene-propylene copolymers, hydrogenated styrene-isoprene polymers, hydrogenated radical isoprene polymers, poly(meth)acrylate acid esters, polyalkyl styrenes, polyolefins, polyalkylmethacrylates and esters of maleic anhydride-styrene copolymers, or mixtures thereof. In one embodiment the polymeric thickener is poly(meth)acrylate.

Antiwear Agent

The lubricant composition optionally further comprises at least one other antiwear agent. Examples of suitable antiwear agents include a sulphurised olefin, sulphur-containing ashless anti-wear additives are metal dihydrocarbyldithiophosphates (such as zinc dialkyldithiophosphates), thiocarbamate-containing compounds, such as thiocarbamate esters, thiocarbamate amides, thiocarbamic ethers, alkylene-coupled thiocarbamates, and bis(S-alkyldithiocarbamyl) disulphides.

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature from 25° C. to 125° C. U.S. Pat. Nos. 4,758,362 and 4,997,969 describe dithiocarbamate compounds and methods of making them.

Examples of suitable olefins that may be sulphurised to form an the sulphurised olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulphurised olefin includes fatty acids and their esters. The fatty acids are often obtained from vegetable oil or animal oil; and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

In an alternative embodiment, the ashless antiwear agent may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the friction modifier mixture from 5 to 95, in several embodiments from 10 to 90, or 20 to 85, or 20 to 80 weight percent of said mixture. The aliphatic carboxylic acids (especially a monocarboxylic acid) which form the esters are those acids typically containing 12 to 24 or 14 to 20 carbon atoms. Examples of carboxylic acids include dodecanoic acid, stearic acid, lauric acid, behenic acid, and oleic acid.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol. Often the polyol is diethylene glycol, triethylene glycol, glycerol, sorbitol, pentaerythritol or dipentaerythritol.

The commercially available monoester known as "glycerol monooleate" is believed to include 60±5 percent by weight of the chemical species glycerol monooleate, along with 35±5 percent glycerol dioleate, and less than 5 percent trioleate and oleic acid. The amounts of the monoesters, described above, are calculated based on the actual, corrected, amount of polyol monoester present in any such mixture.

Antiscuffing Agent

The lubricant composition may also contain an antiscuffing agent. Antiscuffing agent compounds are believed to decrease adhesive wear are often sulphur containing compounds. Typically the sulphur containing compounds include organic sulphides and polysulphides, such as dibenzyldisulphide, bis-(chlorobenzyl) disulphide, dibutyl tetrasulphide, di-tertiary butyl polysulphide, sulphurised methyl ester of oleic acid, sulphurised alkylphenol, sulphurised dipentene, sulphurised terpene, sulphurised Diels-Alder adducts, alkylsulphenyl N'N-dialkyl dithiocarbamates, the reaction product of polyamines with poly-basic acid esters, chlorobutyl esters of 2,3-dibromopropoxyisobutyric acid, acetoxymethyl esters of dialkyl dithiocarbamic acid and acyloxyalkyl ethers of xanthogenic acids and mixtures thereof.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentyl-phenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; the zinc salts of a phosphorodithioic acid; amine salts of alkyl and dialkylphosphoric acids, including, for example, the amine salt of the reaction product of a dialkyldithiophosphoric acid with propylene oxide; and mixtures thereof.

Other performance additives such as corrosion inhibitors including octylamine octanoate, condensation products of dodecenyl succinic acid or anhydride and a fatty acid such as oleic acid with a polyamine; metal deactivators including derivatives of benzotriazoles, dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides; and friction modifiers including fatty acid derivatives such as amines, esters, epoxides, fatty imidazolines, condensation products of carboxylic acids and polyalkylene-polyamines and amine salts of alkylphosphoric acids may also be used in the lubricant composition.

INDUSTRIAL APPLICATION

The overbased detergent of the invention is suitable for any lubricant composition. Examples of a lubricant include at least one of a fuels (diesel gasoline, bio-diesel etc.), transmission fluids, gear oils, hydraulic fluids, metal working fluids, or internal combustion engine lubricants. In another embodiment lubricant technology comprises greases.

In one embodiment the internal combustion engine, may be a diesel fuelled engine, a gasoline fuelled engine, a natural gas fuelled engine or a mixed gasoline/alcohol fuelled engine. In one embodiment the internal combustion engine is a diesel fuelled engine and in another embodiment a gasoline fuelled engine.

The internal combustion engine may be a 2-stroke or 4-stroke engine. Suitable internal combustion engines include a marine diesel engine, aviation piston engines, low-load diesel engines, automobile and truck engines.

In several embodiments a suitable lubricating composition comprises additives present on an actives basis in ranges as shown in Table 2.

TABLE 2

| | Embodiments (wt % of lubricant composition) | | | |
|---|---|---|---|---|
| | A | B | C | D |
| Overbased Detergent | 0.01-60 | 0.1-50 | 1-40 | 1.5-30 |
| Other Performance Additives | 0-30 | 0.01-25 | 0.1-20 | 0.5-15 |
| Oil of Lubricating Viscosity | 10-99.99 | 25-99.89 | 40-99.4 | 55-98 |

The following examples provide an illustration of the invention. These examples are non exhaustive and are not intended to limit the scope of the invention.

EXAMPLES

Preparative Example of the Suspensions

Preparative Example 1

A dispersion containing 50 wt % lime, 10 wt % of an alkyl benzene sulphonic acid surfactant and 40 wt % oil is milled in a horizontal bead mill with a milling chamber of suitable size appropriate for the scale of the operation. The bead size filling the chamber (typically 65 vol. %) is typically in the range 0.7 mm to 0.1 mm diameter (e.g. 0.3 mm+/−0.05 mm beads). After a suitable amount of milling, typically 4 to 20 minutes residence time (i.e. the actual time the suspension spends in the mill) the required particle size is achieved (i.e. ≦1 μm) as determined by Coulter® LS230 Particle Size Analyser. The suspension is easy to pour and stable for several weeks between −20° C. and +60° C., showing no tendency to stratify or to form a gel.

Examples 1 and 2

Preparation of Salixarate Detergents

A salixarene detergent substrate in a conventional amount of diluent oil, acetic acid and the product of Preparative Example 1 are charged to a vessel, equipped with a lid and clip, stirrer gland, paddle and mechanical stirrer, thermocouple with Eurotherm™ heating system and a condenser, a carbonation tube and one stoppered port. The stirrer is set to 600 rpm and the temperature is raised to 57° C., where a mixture of alcohol (isobutyl, amyl alcohols and methanol), is added via the stoppered port opening. The mixture is then carbonated using carbon dioxide followed by adding additional lime charges and then further carbonated up to 4 more times. Once the final carbonation is complete the equipment is set up for vacuum distillation (splash head, condenser and collection flask). The temperature is gradually increased to 149° C., at reduced atmospheric pressure before applying a full vacuum to remove the water of reaction, alcohols, carbonation catalyst, and other volatiles. The mixture is then cooled for sediment testing and filtration. Filtration is carried out using a sinter funnel with a Fax-5™ filter aid pad.

Example 1 is prepared by employing the process described immediately above with 2 additions of lime and using a suspension with a mean particle size of about 0.2 μm. The reactants are added to 37.2 g of oil, and the reactants are present at: salixarene detergent substrate 473 g, acetic acid 4 g, 49.8 g of amyl/butyl alcohol mixture, 26.2 g of methanol, 7.8 g water and carbon dioxide for the carbonation steps 14 g (first carbonation) and 17 g (second addition). The prepared lime dispersion with a metal base content of 50 wt % of the suspension is added at 64.7 g and 62.2 g respectively before the first and second carbonation step. The TBN of the product is 128.8 mg/KOH. It has a calcium content of 4.6 wt % and requires filtration for less than 1 day.

Comparative Example 1 employs a process similar to that described above for Example 1, except the appropriate amount of lime is added from conventional sources i.e. not a pre-prepared lime suspension. The TBN of Comparative Example 1 is 124.3 mg/KOH. It has a calcium content of 4.3 wt % and requires filtration for less than 2 days.

Example 2 employs the same process as Example 1, except the process involves 6 additions of lime from the dispersion. The reactants are present in at salixarene detergent substrate 292.4 g, acetic acid 4 g, 30.8 g of amyl/butyl alcohol mixture, 29.4 g of methanol, and 2.1 g water. For each of the six carbonation steps the lime dispersion is added at 50 g each (total of 300 g). Carbon dioxide is charged at 200 ml/min for 46 minutes each. The TBN of Comparative Example 1 is 247.6 mg/KOH. It has a calcium content of 9 wt %; and requires filtration for about 2 days.

Comparative Example 2 employs the same process described above for Example 2, except the appropriate amount of lime is added from conventional sources. The product of the process cannot be filtered.

Comparative Example 3 employs the same process described above for Example 1, except the appropriate amount of lime is in the form of a slurry with a lime mean particle size of 19 μm. The product has a TBN of 118.7, calcium content of 4.3 wt % and requires filtration for about 2 days.

Example 3 is a sulphonate detergent prepared by mixing in a vessel (equipped with stirrer, thermowell, and condenser), 28.5 g of a polyolefin succinic anhydride, and 28.5 g of an amyl/butyl alcohol mixture, in the presence of 34.7 g of diluent oil to form a mixture and 36.5 g of a lime dispersion (containing 50 wt % calcium, 10 wt % surfactant and 40 wt % oil). To the mixture with continued stirring is added to 4.9 g of acetic acid and 3.5 g of water. 193 g of $C_{16-36}$ alkyl sulphonic acid detergent substrate is added before heating to 100° C. for 2 hours. The mixture is then heated to 162° C. under vacuum and allowed to cool. To the mixture another 89 g of lime dispersion, 59 g of methanol and 24.9 g of calcium phenate are added followed by stirring at 51° C. for 20 minutes. The mixture is then carbonated using carbon dioxide (300 ml/min). The addition of dispersion and carbon dioxide is repeated a further 7 times. The product is stripped and filtered using a Fax-3™ pad. The product yields 970 g (71.4% conversion), a TBN of 438, calcium content of 16.83 wt %; and a solids content of 2.8%. The product filters easily over 2 days.

Example 4 employs a similar procedure as Example 3, except 6 carbonation steps are used. The product yields 763 g (81.6% conversion), a TBN of 388, calcium content of 14.99 wt %; calcium content of 14.99 wt %; and a solids content of 2.4%. The product filters easily over 2 days.

Comparative Example 4 is prepared in a vessel, equipped with an extended 1 liter stirrer is charged 1,200 g of oil and 300 g of an alkyl sulphonic acid surfactant substrate. 1,500 g of $Ca(OH)_2$ is metered into the vessel over time allowing as much to disperse as possible. With stirring at 250 rpm, the mixture is allowed to stir for 6 days. The resultant product is a slurry. The slurry is then used to prepare a sulphonate detergent in a similar process to that described for Example 4, except the lime for Example 4, is the slurry. The final overbased sulphonate detergent has a solids content of 12% and the product filters poorly over 2 days to yield 30.3%.

Example 5 is preparation of an overbased calcium salixarate detergent prepared in a similar process to Example 1, except no amyl/butyl alcohol is used. The reactants are present at salixarene detergent substrate 292.4 g, acetic acid 4 g, 29.4 g of methanol, and 2.1 g water. For each of the four carbonation steps the lime dispersion is added at 150 g each. Carbon dioxide is charged at 200 ml/min for 46 minutes each. The TBN of Example 5 is 278 mg/KOH, it has a calcium content of 9.9 wt %; and required filtration for about 2 days.

Example 6 is similar to Example 1, except no carbonation catalyst (acetic acid) is used. The reactants are present at salixarene detergent substrate 292.4 g, 42 g of butyl/amyl alcohol, 29.4 g of methanol, and 2.1 g water. For each of the two carbonation steps the lime dispersion is added at 150 g each (total of 300 g). Carbon dioxide is charged at 200 ml/min for 46 minutes each. The TBN of Example 6 is 283 mg/KOH. It has a calcium content of 10.1 wt % and requires filtration for about 2 days.

Example 7 is the preparation of an overbased sulphurised calcium phenate detergent. A vessel is charged with 104 g of a sulphur containing dodecyl substituted phenol, 1.05 g of sulphur, 39.4 g of oil, 4 g of calcium acetate, 76 g of stearic acid and 148 g of the product from the Preparative Example of the suspension (supplying lime). The vessel is equipped with a lid and clip, stirrer gland, paddle, mechanical stirrer, thermocouple with Eurotherm™ heating system, splash-head with condenser, vacuum receiver, and round-bottomed flask. The vessel is heated to 145° C. with stirring at 800 rpm under reduced pressure. 110 g of 2-ethylhexanol is added slowly through a pressure equalised dropping funnel. The pressure of the vessel is then increased to atmospheric before supplying carbon dioxide (at a rate of 250 ml $min^{-1}$ for a period of 76 minutes. A second lime addition of 96 g is then followed by carbonating with more carbon dioxide for 76 minutes. The vessel is then placed under vacuum and the temperature increased to 210° C., and held for 30 minutes. The vessel is then cooled to ambient and the product is filtered. The product has a TBN of 318, a calcium content of 11.3 wt % and a solids content of 16%.

Example 8 is a hybrid overbased calcium detergent composed of a sulphonic acid and an alkyl phenol. 540 g of toluene, 276 g of methanol and 290 g of the product of the preparative Example of the suspension (lime dispersion) are mixed at ambient temperature in a vessel. Then 238 g of sulphurised alkyl phenol and 110 g of alkyl sulphonic acid (with molecular weight of 683) are charged along with 22 g of water and an additional 50 g of toluene at 40° C. After neutralization the vessel is cooled to 28° C. while 62 g of carbon dioxide is injected. The reaction temperature is increased to 60° C. over a period of 1 hour, before cooling to 28° C. 254 g of lime dispersion is added and a second carbonation step carried out, whilst heating to 60° C. over 90 minutes. The product of the reaction is cooled and filtered.

Preparative Example 2 is a dispersion of magnesium oxide (50 wt %), 40 wt % oil and 10 wt % of a polyisobutylene succinimide (polyisobutylene having number average molecular weight of between 800 and 1600) surfactant. The dispersion is prepared in a similar manner as Preparative Example 1. The dispersion has a mean particle size of the magnesium oxide particles of 0.38 μm.

Comparative Example 5 is an overbased magnesium saligenin detergent. To a vessel equipped with stirrer, stopper, thermowell, and reflux condenser, the following are charged: 670 g diluent oil (mineral oil), 1000 g dodecyl phenol, and a solution of 2.5 g NaOH in 40 g water. The mixture is heated to 35° C. with stirring (350 r.p.m.). When 35° C. is attained, 252 g of paraformaldehyde (90%) is added to the mixture and stirring is continued. After 5 minutes, 4.9 g of magnesium oxide and 102 g of additional diluent oil are added. The mixture is heated to 79° C. and held at temperature for 30 minutes. A second increment of 58.1 g magnesium oxide is added and the batch further heated and maintained at 95-100° C. for 1 hour. Thereafter the mixture is heated to 120° C. under a flow of nitrogen at 28 L/hour. When 120° C. is reached, the vessel is charged with 252 g diluent oil, and the mixtures is stripped for 1 hour at a pressure of 2.7 kPa (20 torr) at 120° C. for 1 hour and then filtered. The product contains 4% solids, has a TBN of 70 and 1.34 wt % magnesium. The reaction yield is 81.3%.

Example 9 is an overbased magnesium saligenin prepared in a similar manner to Comparative Example 5, except the magnesium oxide source is from the dispersion of Preparative Example 2. The product has a TBN of 70.4, a magnesium content of 1.58 wt %, a solids content of 4% and a reaction yield of 85%.

Example 10 is a sulphonate detergent prepared by mixing in a vessel (equipped with stirrer, thermowell, and condenser), 28.5 g of a polyolefin succinic anhydride, and 28.5 g of an amyl/butyl alcohol mixture, in the presence of 91.7 g of diluent oil to form a mixture and 31.4 g of a lime dispersion (containing 55 wt % calcium, 12 wt % surfactant and 33 wt % oil). To the mixture with continued stirring is added to 4.9 g of acetic acid and 3.5 g of water. 183 g of $C_{16-36}$ alkyl sulphonic acid detergent substrate is added over approximately 12 minutes. The mixture exotherms from 27° C. up to 43.4° C. and is then heated to 87° C., held for approximately 2 hours and then stripped to 152.5° C. and allowed to cool. To the relatively clear mixture is charged 24.9 g of calcium phenate, 59 g of methanol and 98.5 g of an amyl/butyl alcohol mixture. While stirring 81.2 g of lime dispersion is added followed by heating to 51.5° C. for 30 minutes. The mixture is carbonated using carbon dioxide with a flow rate of 1.6 $cm^3/s$ (or 0.2 cfh) for 25 minutes while stirring at 500 rpm. The addition of lime dispersion and carbon dioxide is repeated a further 5 times holding for 20 minutes after each addition before resuming carbonation for 55 minutes each and 63 minutes. The mixture is stripped to 155° C. with nitrogen gas at 5.5 $cm^3/s$ (or 0.7 cfh) and allowed to cool. A small sample is filtered and stripped and found to have a TBN of 415. To the remainder is added 59 g of methanol, 98.5 g of an amyl/butyl alcohol mixture. While stirring 81.2 grams of lime dispersion is added, the mixture heated to approximately 53° C. and held for 20 minutes. The mixture is then carbonated with carbon dioxide at 1.6 $cm^3/s$ (or 0.2 cfh) for 55 minutes while stirring at 500 rpm. The addition of lime dispersion and carbon dioxide is repeated 5 additional times with the same amounts and hold times (for a total of 12 additions of 81.2 g each of lime dispersion). The final increment is carbonated for 65 minutes. An analytical sample is filtered through paper and stripped giving a sample with a TBN of 503. The rest of product is stripped to 155° C. and filtered using Fax-3 filter yielding 1252 g.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for preparing an overbased detergent, the process comprising: reacting (a) a pre-prepared suspension comprising (i) a calcium or magnesium metal base with a mean particle size of about 1 micrometers or less, (ii) a surfactant comprising an ionic or non-ionic compound with a hydrophilic lipophilic balance of about 1 to about 18, and (iii) an organic medium comprising an oil of lubricating viscosity, a liquid fuel, a hydrocarbon solvent, or mixtures thereof, in which the metal base is suspended; wherein the metal base is suspended uniformly in the organic medium by a physical process and wherein the physical process results in the metal base having a mean particle size of less than about 1 micrometer; (b) an acidifying overbasing agent; and (c) an acidic or neutralised detergent substrate, to form an overbased detergent, wherein the physical process comprises milling, and wherein the amount of metal base present in the suspension ranges from about 40 wt % to about 65 wt % of the suspension.

2. The process of claim 1, wherein the suspension is a dispersion.

3. The process of claim 1, wherein the physical process results in the metal base of the suspension having a mean particle size of at least about 10 nanometers to less than about 1 μm.

4. The process of claim 1, wherein the overbased detergent is a sulphonate detergent with a TBN of at least about 350 to about 920 or a phenate, salixarate or salicylate detergent with a TBN ranging from about 105 to about 500.

5. The process of claim 1, wherein the metal base is a carbonate, oxide, hydroxide, or mixtures thereof.

6. The process of claim 1, wherein the surfactant comprises at least one of a saligenin, a hydrocarbyl substituted aryl sulphonic acid, a polyolefin-substituted acylating agent, or a salixarene, or a salt thereof.

7. The process of claim 1, wherein the organic medium comprises an oil of lubricating viscosity.

8. The process of claim 1 further comprising employing a mixture of at least one of alcohols, co-surfactants or co-promoters.

9. The process of claim 1, wherein the process involves adding 1 to 10 metal base additions, thereafter removing at least a portion of water and of alcohols from the process, and a processing step of filtering or stripping the product to form the overbased metal detergent.

10. A lubricant or a lubricant concentrate composition comprising: an oil of lubricating viscosity and the overbased detergent of claim 1.

11. The lubricant or lubricant concentrate of claim 10 wherein the lubricant is at least one of transmission fluids, gear oils, hydraulic fluids, metal working fluids, greases, or internal combustion engine lubricants.

12. The process of claim 1, wherein the physical process comprises milling in a vertical or horizontal bead mill.

13. The process of claim 1, wherein the surfactant has a HLB of 2.5 to 15.

14. The process of claim 1, wherein the surfactant has a HLB of 2.5 to 6.

15. The process of claim 1, wherein the surfactant has a HLB of 1 to 8.

* * * * *